US006988487B2

(12) United States Patent
Oono et al.

(10) Patent No.: US 6,988,487 B2
(45) Date of Patent: Jan. 24, 2006

(54) FUEL INJECTION CONTROL DEVICE OF INTERNAL COMBUSTION ENGINE

(75) Inventors: Takahiko Oono, Hyogo (JP); Toshiaki Date, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/004,893

(22) Filed: Dec. 7, 2004

(65) Prior Publication Data

US 2005/0252491 A1 Nov. 17, 2005

(30) Foreign Application Priority Data

May 12, 2004 (JP) ..... P2004-142786

(51) Int. Cl.
*F02M 37/04* (2006.01)

(52) U.S. Cl. ..... 123/447; 123/325; 123/332; 123/198 F

(58) Field of Classification Search ..... 123/446, 123/447, 456, 198 D, 198 DB, 516, 198 F, 123/325, 326, 332, 333
See application file for complete search history.

(56) References Cited

U.S. PATENT DOCUMENTS 4,535,744 A * 8/1985 Matsumura ..... 123/493
4,841,936 A * 6/1989 Takahashi ..... 123/447
4,941,442 A * 7/1990 Nanyoshi et al. ..... 123/333
5,924,403 A * 7/1999 Thomas ..... 123/300
6,105,554 A * 8/2000 Nishiyama ..... 123/436
2003/0136373 A1 * 7/2003 Naik ..... 123/295

FOREIGN PATENT DOCUMENTS

JP 11-82105 A 3/1999

* cited by examiner

*Primary Examiner*—Carl S. Miller
(74) *Attorney, Agent, or Firm*—Sughrue Mion, PLLC

(57) ABSTRACT

The present invention provides a fuel injection control device which can prevent the occurrence of a phenomenon that when a pressure of fuel in the inside of a pressure storage chamber is elevated during a fuel cut, and the injection of fuel is restarted, the fuel is injected at a high fuel pressure largely different from a target fuel pressure. Accordingly, the fuel injection control device can prevent the deterioration of an exhaust gas and the occurrence of an engine stop. The fuel injection control device includes fuel injection valve control means which performs a driving control of the fuel injection valves, a fuel pressure sensor which detects a fuel pressure in the inside of the pressure storage chamber, a discharge amount control valve which controls a fuel amount supplied from the high-pressure pump to the pressure storage chamber, and fuel pressure control means which controls the discharge amount control valve such that the fuel pressure in the inside of the pressure storage chamber agrees with a target fuel pressure, wherein when the fuel pressure in the inside of the pressure storage chamber assumes a given pressure state during a fuel cut control, the forced fuel injection control means gives a driving instruction to the fuel injection valve control means to interrupt the fuel cut control thus enabling forced driving of the fuel injection valves of given cylinders.

8 Claims, 6 Drawing Sheets

FUEL INJECTION CONTROL DEVICE OF INTERNAL COMBUSTION ENGINE

BACKGROUND OF THE INVENTION

1. Field of the Invention

The present invention relates to a fuel injection control device of an internal combustion engine, and more particularly to a fuel injection control device which directly injects fuel into the inside of a combustion chamber of an engine while controlling a fuel pressure in a pressure storage chamber to a high-pressure target fuel pressure.

2. Description of the Related Art

Recently, an internal combustion engine which controls a fuel pressure in a pressure storage chamber such that the fuel pressure assumes an optimum high pressure value for a combustion state and directly injects fuel into a combustion chamber has been commercialized and one example of the constitution of a fuel supply system of this type of internal combustion engine is explained in conjunction with FIG. 8.

In FIG. 8, a high-pressure pump 20 is provided for pressurizing the fuel to a high pressure and the high-pressure pump 20 includes a cylinder 21, a plunger 22 which reciprocates in the inside of the cylinder 21, and a pressurizing chamber 23 which is defined and formed by an inner peripheral wall surface of the cylinder 21 and an upper end surface of the plunger 22. A lower end of the plunger 22 is brought into pressure contact with a cam 25 which is formed on a camshaft 24 of the engine, wherein due to the rotation of the cam 25 induced by the rotation of the camshaft 24, the plunger 22 reciprocates in the inside of the cylinder 21 thus changing a volume inside the pressurizing chamber 23.

Further, an inflow passage 30 which is connected to an upstream of the pressurizing chamber 23 is connected with a fuel tank 32 by way of a low pressure pump 31. Here, the low pressure pump 31 sucks and discharges the fuel in the fuel tank 32 and the fuel discharged from the low pressure pump 31 is regulated to a given low pressure value by a low-pressure regulator 33, and, thereafter, the fuel is introduced into the inside of the pressurizing chamber 23 by way of a check valve 34 when the plunger 22 descends in the inside of the cylinder 21.

On the other hand, a supply passage 35 which is connected to a downstream of the pressurizing chamber 23 is connected to a pressure storage chamber 50 by way of a check valve 36, wherein the pressure storage chamber 50 holds the high-pressure fuel discharged from the pressurizing chamber 23 and, at the same time, distributes the fuel into fuel injection valves 51. Further, the check valve 36 is provided for restricting the back flow of the fuel from the pressure storage chamber 50 to the pressurizing chamber 23.

Further, a relief valve 37 which is connected with the pressure storage chamber 50 is a normally-closed valve which is opened at a given valve-opening pressure or more. That is, when the fuel pressure in the inside of the pressure storage chamber 50 is elevated to the above-mentioned valve-opening pressure or more, the relief valve 37 is opened so that the fuel in the inside of the pressure storage chamber 50 is made to return to the fuel tank 32 through a relief passage 38 and hence, the excessive increase of the fuel pressure in the inside of the pressure storage chamber 50 is prevented.

A discharge amount control valve 10 formed on a spill passage 39 which is connected to the pressurizing chamber 23 in common with the supply passage 35 is, for example, a normally-open electromagnetic valve. During a period in which the plunger 22 is moved upwardly in the inside of the cylinder 21, so long as a valve-opening control of the discharge amount control valve 10 is performed, the fuel which is discharged from the pressurizing chamber 23 to the supply passage 35 is made to return from the spill passage 39 to the inflow passage 30 so that the high-pressure fuel is not supplied to the pressure storage chamber 50. Then, after the discharge amount control valve 10 is closed at a given timing during the upward movement of the plunger 22 in the inside of the cylinder 21, the pressurized fuel discharged from the pressurizing chamber 23 to the supply passage 35 is supplied to the pressure storage chamber 50 through the check valve 36.

To an ECU 60 which constitutes an electronic control unit, detection signals from a rotational speed sensor 62 which detects a rotational speed of an engine 40, an accelerator position sensor 64 which detects a step-in amount of an accelerator pedal 63 and the like are inputted. The ECU 60 determines a target fuel pressure PO based on these engine operation information, and performs a feedback control of open/close timing of the discharge amount control valve 10 such that a fuel pressure PR detected by a fuel pressure sensor 61 which detects the fuel pressure in the inside of the pressure storage chamber 50 agrees with the target fuel pressure PO.

Further, the ECU 60 calculates a fuel injection amount which makes an air-fuel ratio detected by an air-fuel ratio sensor 66 arranged on an exhaust pipe assumes a target air-fuel ratio based on an intake air flow rate detected by an air flow sensor 65, an engine rotational speed detected by the rotational speed sensor 62, the fuel pressure in the inside of the pressure storage chamber 50 detected by the fuel pressure sensor 61 and performs a driving control of the fuel injection valves 51.

In the fuel injection control device having the above-mentioned constitution, the change of various state variables when the engine is shifted from a steady state operation to a deceleration operation is explained in conjunction with a timing chart shown in FIG. 7.

In FIG. 7, until a point of time t1, an intake air flow rate qa1 in response to a step-in amount ap (a fixed value) of the accelerator pedal 63 is taken into the inside of a combustion chamber, wherein the fuel injection flow rate qi1 which assumes the target air-fuel ratio is injected from the fuel injection valves 51 based on the intake air flow rate qa1 and the target air-fuel ratio which is preliminarily set in response to the engine operation state so that the state operation is performed with the engine rotational speed maintained at a fixed rotational speed.

Here, a pump discharge flow rate qp1 which is substantially equal to the fuel injection flow rate qi1 is discharged from the high-pressure pump 20 so that the fuel pressure PR (=ph) in the inside of the pressure storage chamber 50 indicated by a solid line agrees with the target fuel pressure PO (=ph) indicated by a chain line.

When the accelerator pedal 63 is released so that the accelerator step-in amount assumes the zero position at the point of time t1, the decrease of the intake air flow rate is started from qa1 and hence, the decrease of the fuel injection flow rate is also started from qi1. As a result, the generated torque of the engine is lowered so that the engine rotational speed is also lowered gradually. At this point of time, the target fuel pressure PO is changed from the set value ph when the accelerator step-in amount is ap to the set value p1 when the accelerator step-in amount assumes the zero position. Accordingly, the relationship between the fuel pressure PR in the inside of the pressure storage chamber 50 indicated by a solid line and the target fuel pressure PO indicated by a chain line becomes fuel pressure PR (=ph)>target fuel pressure PO (=p1) and hence, the discharge amount control valve 10 is controlled such that the discharge flow rate of the high-pressure pump 20 becomes zero. Then, during a period from the point of time t1 at which the accelerator step-in amount is changed to the zero position to a point of time t2 at which a fuel cut control is started, the fuel in the inside of the pressure storage chamber 50 is consumed corresponding to the fuel injection flow rate injected from the fuel injection valve 51 so that the fuel pressure PR (solid line) in the inside of the pressure storage chamber 50 is gradually lowered from ph to pm.

When the engine rotational speed is lowered to a fuel cut start rotational speed nfcin at the point of time p2, the fuel cut control is started so that the fuel injection flow rate is controlled to zero. When the fuel injection flow rate becomes zero, the consumption of the fuel in the inside of the pressure storage chamber 50 is stopped and the fuel pressure PR (solid line) in the inside of the pressure storage chamber 50 is being held at approximately pm during the period from the point of time t2 to a point of time t3 in which the fuel cut control is executed.

When the engine rotational speed is lowered to the fuel cut finish rotational speed nfcout at the point of time t3, the fuel cut control is finished. Then, the fuel injection flow rate qi2 which assumes the target air-fuel ratio is injected from the fuel injection valves 51 again based on the intake air flow rate qa2 at the point of time t3 and the target air-fuel ratio which is preliminarily set corresponding to the engine operation state.

However, at the point of time t3, the fuel pressure PR in the inside of the pressure storage chamber 50 indicated by the solid line is substantially held at pm. Accordingly, the relationship between the fuel pressure PR (=pm) in the inside of the pressure storage chamber 50 indicated by a solid line and the target fuel pressure PO (=p1) indicated by a chain line becomes fuel pressure PR>target fuel pressure PO and hence, the discharge amount control valve 10 is kept controlled such that the discharge flow rate of the high-pressure pump 20 becomes zero.

After the point of time t3, the fuel in the inside of the pressure storage chamber 50 is again consumed in response to the fuel injection flow rate qi2 which is injected again after finishing of the fuel cut so that the fuel pressure PR in the inside of the pressure storage chamber 50 indicated by the solid line is gradually lowered from pm to p1.

Then, the operation reaches a point of time t4 at which the fuel pressure PR (=p1) in the inside of the pressure storage chamber 50 indicated by the solid line and the target fuel pressure PO (=p1) indicated by a chain line agree with each other, the pump discharge flow rate qp2 which is substantially equal to the fuel injection flow rate qi2 is discharged from the high-pressure pump 20 and, after the point of time t4, the control is maintained in a state that the fuel pressure PR indicated by the solid line and the target fuel pressure PO indicated by a chain line agree with each other.

Here, when the engine is at the high temperature due to the operation thereof, the fuel pressure PR in the inside of the pressure storage chamber 50 exhibits the behavior indicated by a broken line in FIG. 7. That is, in a state that the consumption of the fuel in the inside of the pressure storage chamber 50 is stopped due to the fuel cut (period from the point of time t2 to the point of time t3), the fuel which stays in the inside of the pressure storage chamber 50 having a fixed volume receives heat emitted from the engine and the fuel is volumetrically swelled due to the heating whereby the sharp rise of the fuel pressure such as the fuel pressure PR indicated by a broken line is generated.

When the fuel pressure PR in the inside of the pressure storage chamber PR is sharply elevated during the fuel cut and is held at px and then the fuel cut control is finished at the point of time t3, compared to the target fuel pressure PO (=p1) indicated by a chain line, the injection of the fuel is started again while holding the extremely high-value fuel pressure PR (=px). Further, the time necessary for lowering the fuel pressure PR (=px) to the target fuel pressure PO (=p1) is largely prolonged.

In this manner, when the injection of the fuel is restarted with the high fuel pressure value px which is largely different from the target fuel pressure PO, a penetrating force of the injected fuel spray is increased so that the reachable distance of the fuel is increased whereby the fuel adheres to a top surface of the piston or a cylinder wall. Accordingly, the formation of the air-gas mixture optimum to the engine cannot be realized whereby an exhaust gas is deteriorated, or the fuel pressure PR becomes excessively high so that the fuel injection valve 51 cannot be driven with desired response performance, and the engine may be stopped in a worst case.

As one example of a conventional device which overcomes such a drawback, for example, there has been known a device disclosed in JP-A-11-82105 (hereinafter referred to as patent document 1).

In this patent document 1, a following technique is proposed. That is, when the fuel injection amount is sharply decreased as in the case of sharply decelerating the speed of a vehicle from the high speed traveling, when the fuel pressure PR becomes higher than the target fuel pressure PO by a given value or more, the fuel injection valves 51 are driven with the second fuel injection amount Qbd×K(here, 0<K<1)which is smaller than the first fuel injection amount Qbd which corresponds to the fuel injection amount at the time of performing the engine non-load operation thus positively lowering the fuel pressure.

However, although the device described in this patent document 1 is applicable to a diesel engine having a wide combustible air-fuel ratio range and a gasoline engine which performs the stratified combustion operation, in a spark ignition gasoline engine which performs the uniform combustion operation in which fuel of a amount in the vicinity of a theoretical air-fuel ratio to the intake air flow rate is premixed in the combustion chamber, when the fuel is injected with the second fuel injection amount irrelevant to the intake air flow rate, the air-fuel ratio is largely deviated from the theoretical air-fuel ratio so that not only the exhaust gas is deteriorated but also, in a worst case the air-fuel ratio goes beyond the combustible air-fuel ratio range thus giving rise to the possibility of the occurrence of misfire or an engine stop.

SUMMARY OF THE INVENTION

The present invention has been made in view of the above-mentioned drawbacks and it is an object of the present invention to provide a fuel injection control device of an internal combustion engine which can prevent the deterioration of an exhaust gas and the occurrence of an engine stop by preventing the restarting of the injection of fuel during a fuel cut control while holding a state in which a fuel pressure in the inside of a pressure storage chamber is excessively elevated.

Further, it is also an object of the present invention to provide a fuel injection control device of an internal combustion engine which, at the time of performing forced driving on the fuel injection valves by interrupting the fuel cut control, can minimize the generated torque of the engine and can ensure the desired deceleration performance at the time of performing the forced driving of fuel injection valves by performing the forced driving of only the fuel injection valves of the given cylinders out of all cylinders of the engine and/or by setting the ignition timing in such forced driving to a delay angle side than a normal ignition timing.

Further, it is an object of the present invention to provide a fuel injection control device of an internal combustion engine which can maintain a stable combustion state even in forced driving by controlling a fuel injection amount such that an air-fuel ratio of cylinders which are forcibly driven assumes a value close to a theoretical air-fuel ratio at the time of performing the forced driving of fuel injection valves by interrupting a fuel cut control.

(1) A fuel injection control device of an internal combustion engine according to the present invention includes fuel injection valves which directly inject fuel in the inside of a combustion chamber of an engine, fuel injection valve control means which performs a driving control of the fuel injection valves by calculating a fuel injection amount which brings a target air fuel ratio which is preliminarily set in response to an engine operation state, a pressure storage chamber which is connected with the fuel injection valve and stores high-pressure fuel, a fuel pressure sensor which detects a fuel pressure in the inside of the pressure storage chamber, a high-pressure pump which pressurizes fuel transported from a fuel tank to the inside of a pressurizing chamber and supplies the high-pressure fuel to the pressure storage chamber, a discharge amount control valve which controls a fuel amount supplied from the high-pressure pump to the pressure storage chamber, and fuel pressure control means which performs a feedback control of a discharge amount control valve such that the fuel pressure in the inside of the pressure storage chamber detected by the fuel pressure sensor agrees with a target fuel pressure which is set in response to the engine operation state, wherein the fuel injection control device includes forced fuel injection control means which, when the fuel pressure in the inside of the pressure storage chamber assumes a given pressure state during a fuel cut control using the fuel injection valve control means, gives a driving instruction to the fuel injection valve control means to interrupt the fuel cut control thus enabling forced driving of the fuel injection valves of given cylinders with a fuel injection amount corresponding to the engine operation state.

(2) Further, the present invention is, in the fuel injection control device of an internal combustion engine described in the above-mentioned (1), characterized in that when the fuel pressure in the inside of the pressure storage chamber exceeds a given high pressure value, the fuel pressure deviation between the fuel pressure in the inside of the pressure storage chamber and the target fuel pressure exceeds a preset given deviation, or the fuel pressure in the inside of the pressure storage chamber exhibits a given elevation behavior against the target fuel pressure, forced driving of the fuel injection valve is performed by interrupting the fuel cut control.

(3) Further, the present invention is, in the fuel injection control device of an internal combustion engine described in the above-mentioned (1) or (2), characterized in that out of all cylinders of the engine, the forced driving is performed only with respect to the fuel injection valves arranged in half cylinders and/or the ignition timing when the forced driving is performed with respect to the fuel injection valves is set to the delay angle side than the normal ignition period such that the generated torque of the engine can be suppressed.

(4) Further, the present invention is, in the fuel injection control device of an internal combustion engine described in any one of the above-mentioned (1) to (3), characterized in that when at least either one of a condition that the fuel pressure no more assumes the given pressure state after the forced driving of the fuel injection valves is started, and a condition that the fuel cut control is finished after the forced driving of the fuel injection valve is started is established, the forced driving of the fuel injection valves is released.

(5) Further, the present invention is, in the fuel injection control device of an internal combustion engine described in any one of the above-mentioned (1) to (4), characterized in that when the forced driving of the fuel injection valves is performed, the fuel injection amount is set such that the air-fuel ratio of the cylinders on which the forced driving is performed assumes a value close to the theoretical air-fuel ratio.

According to the fuel injection control device of an internal combustion engine according to the present invention, it is possible to prevent the restarting of the injection of the fuel while maintaining a state that the fuel pressure in the inside of the pressure storage chamber is excessively elevated during the fuel cut control whereby the deterioration of the exhaust gas and the generation of the engine stop can be obviated.

Further, according to the fuel injection control device of an internal combustion engine according to the present invention, at the time of performing the forced driving of the fuel injection valves by interrupting the fuel cut control, it is possible to suppress the generated torque of the engine to a minimum value and hence, it is possible to ensure the desired deceleration performance at the time of performing the forced driving of the fuel injection valves.

Still further, according to the fuel injection control device of an internal combustion engine according to the present invention, at the time of performing the forced driving of the fuel injection valves by interrupting the fuel cut control, the fuel injection amount is controlled such that the air-fuel ratio of the cylinders on which the forced driving is performed is set to a value close to theoretical air fuel ratio whereby the stable combustion state can be maintained even during the forced driving.

DESCRIPTION OF THE PREFERRED EMBODIMENTS

Embodiment 1

Figure 8:
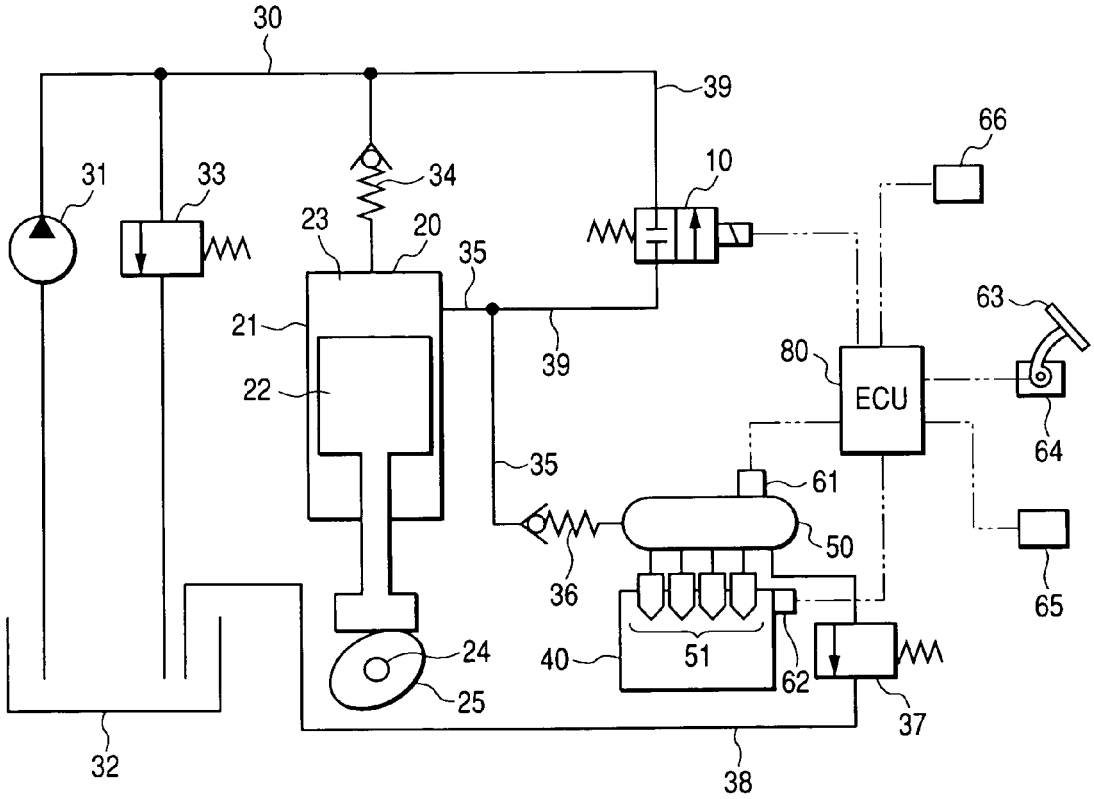
FIG. 8 is a constitutional view showing one example of a fuel supply system of an internal combustion engine.

With respect to a fuel injection control device of an internal combustion engine to which the present invention is applicable, the previously-mentioned constitution of the fuel supply system in conjunction with FIG. 8 is directly applicable as it is.

Hereinafter, the constitution of an ECU 60 which constitutes an electronic control unit of the fuel injection control device according to an embodiment 1 of the present invention is explained in conjunction with a block diagram shown in FIG. 1.

Figure 1:
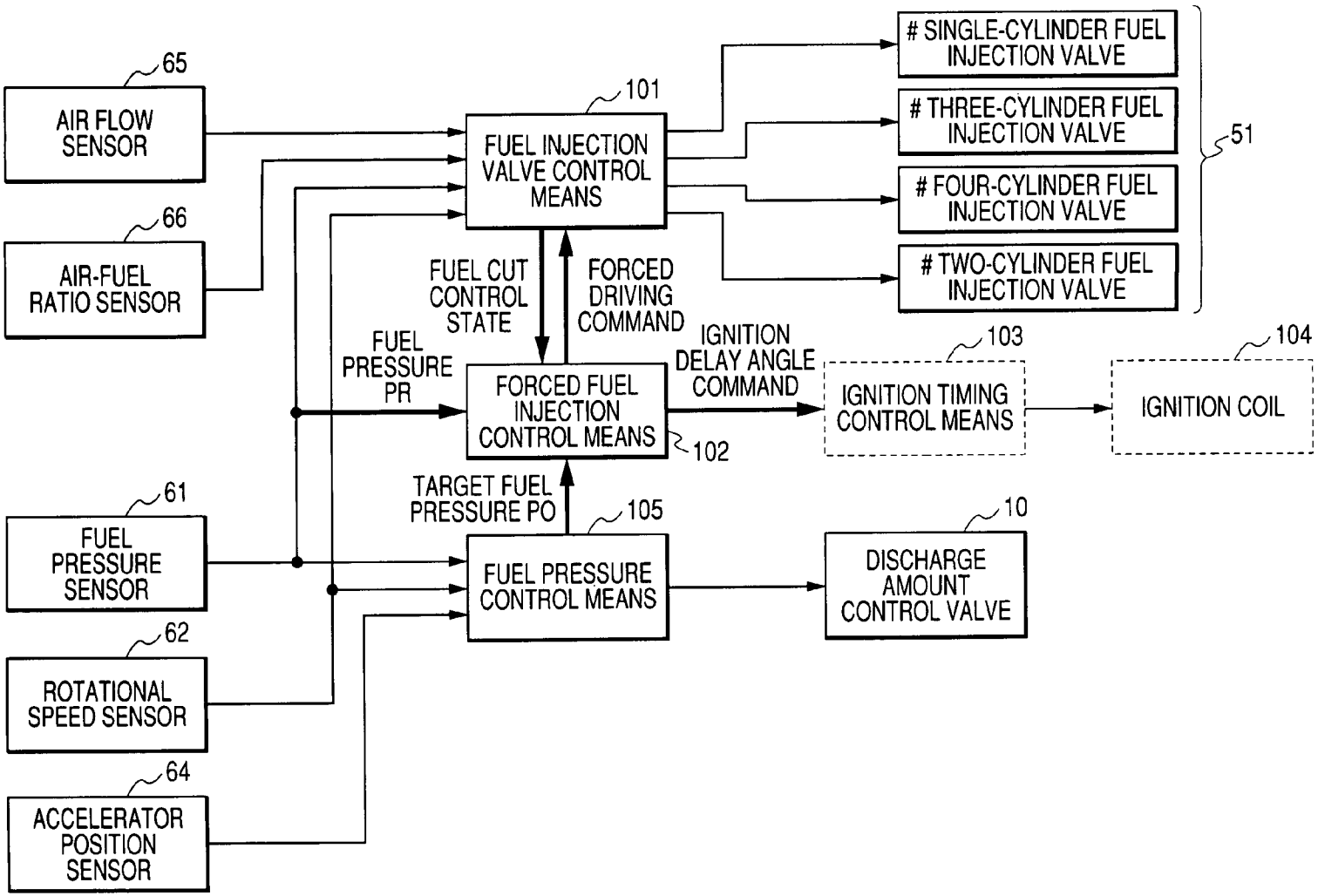
FIG. 1 is a block diagram of a fuel injection control device of an internal combustion engine according to an embodiment 1 of the present invention.

In FIG. 1, based on an engine operation state such as an intake air flow rate detected by an air flow sensor 65, an engine rotational speed detected by a rotational speed sensor 62 or a fuel pressure PR in the inside of a pressure storage chamber 50 detected by a fuel pressure sensor 61, fuel injection valve control means 101 calculates a fuel injection amount which makes an air-fuel ratio detected by an air-fuel ratio sensor 66 arranged in an exhaust pipe assume a target air-fuel ratio which is preliminarily set in response to the engine operation state, and performs a driving control of respective fuel injection valves 51 of #1 cylinder to #4 cylinder independently.

Fuel control means 105 determines a target fuel pressure PO based on an engine operation state such as the engine rotational speed detected by the rotational speed sensor 62 or a step-in amount of an accelerator pedal 63 detected by an accelerator position sensor 64 and, at the same time, performs a feedback control of the open/close timing of a discharge amount control valve 10 such that the fuel pressure PR in the inside of the pressure storage chamber 50 detected by the fuel pressure sensor 61 agrees with the target fuel pressure PO.

Forced fuel injection control means 102 monitors a fuel cut control state of the fuel injection valve control means 101 and determines, when the fuel injection valve control means 101 is under the fuel cut control, whether the fuel pressure PR in the inside of the pressure storage chamber 50 which is detected by the fuel pressure sensor 61 assumes a given pressure state (a state in which the fuel pressure PR exceeds a given high pressure value, a state in which a fuel pressure deviation between the fuel pressure PR and the target fuel pressure PO exceeds a preliminarily set given deviation, or a state in which the fuel pressure PR exhibits a given elevation behavior against the target fuel pressure PO) or not.

Here, when the operation is under the fuel cut control and the fuel pressure PR assumes a given pressure state, the forced fuel injection control means 102 instructs the fuel injection valve control means 101 to perform the forced driving of the fuel injection valves 51. Further, upon receiving the forced driving instruction of the fuel injection valves 51, out of the fuel injection valves 51 of #1 to #4 cylinders, for example, the fuel injection control means 101 performs forced driving on only the fuel injection valves 51 arranged in the #1 cylinder and the #4 cylinder which are half of all the cylinders.

Further, the fuel injection amount is set such that the air-fuel ratio in the cylinders in which the forced driving is performed on the fuel injection valves 51 assumes a value close to the theoretical air-fuel ratio.

Further, the forced fuel injection control means 102 instructs the ignition timing control means 103 to change the ignition timings of the cylinders in which the forced driving is performed on the fuel injection valves 51 thereof to the delay angle side than usual timings and the ignition coils 104 are driven at the instructed ignition timings.

Figure 2:
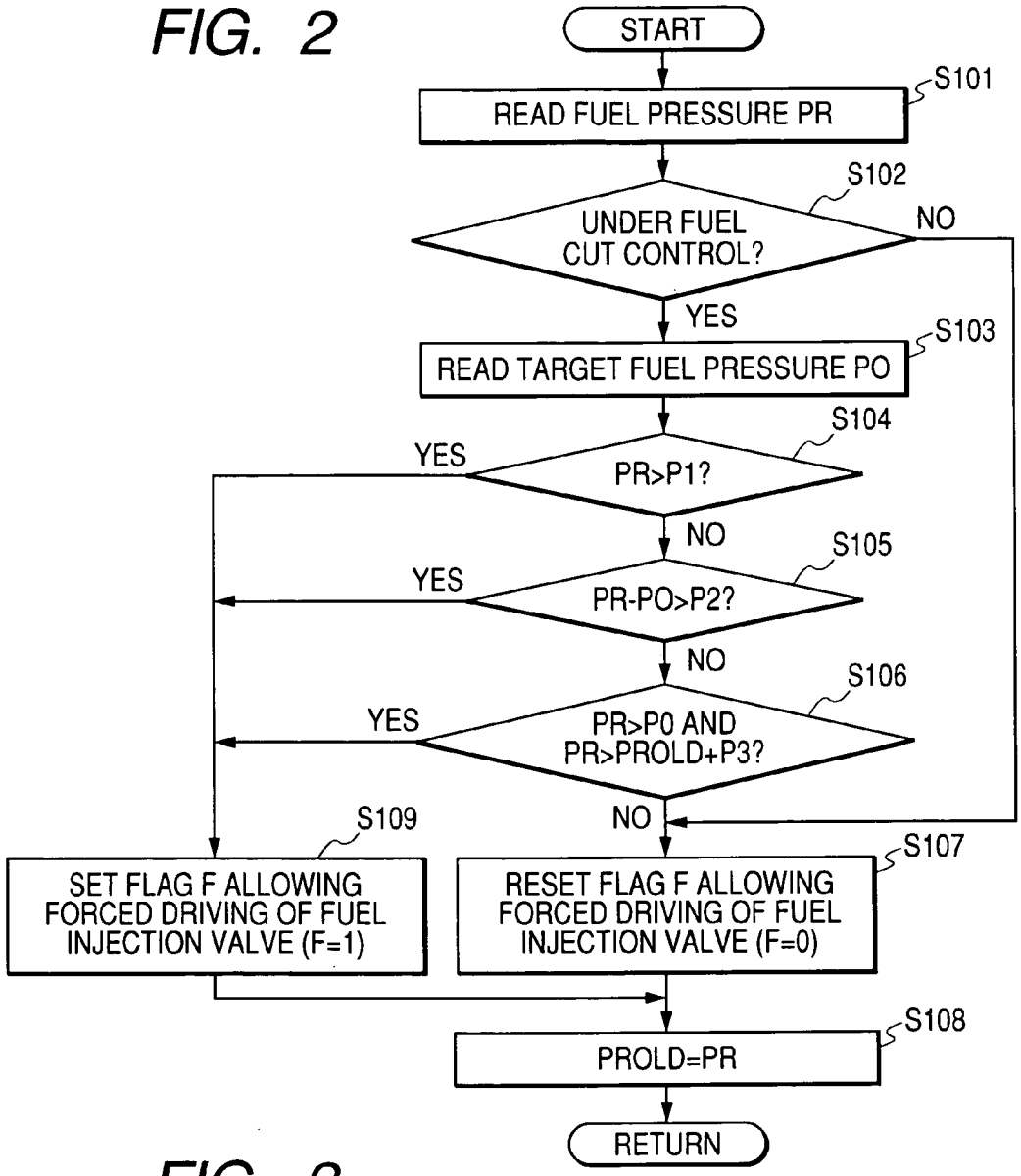
FIG. 2 is a flow chart showing control operations of the fuel injection control device of an internal combustion engine according to the embodiment 1 of the present invention.

Next, the control operation of the forced fuel injection control means 102 is explained in conjunction with a flow chart shown in FIG. 2.

First of all, in step S101, the fuel pressure PR in the inside of the pressure storage chamber 50 detected by the fuel pressure sensor 61 is read.

In step S102, the forced fuel injection control means 102 determines whether the fuel cut control performed by the fuel injection valve control means 101 is under way or not.

When the determination is negative in step S102 (when the fuel cut control is not under way), the processing advances to step S107 and a permission flag of forced driving of the fuel injection valves 51 is reset to F=0. Then, the processing advances to step S108 where the fuel pressure PR which is read this time is stored in a memory PROLD of the control device and the processing is finished.

On the other hand, when the determination is affirmative in step S102 (when the fuel cut control is under way), the processing advances to step S103 and the target fuel pressure PO which is determined by the fuel pressure control means 105 is read and the processing advances to the next step S104.

In step S104, the forced fuel injection control means 102 determines whether the fuel pressure PR which is read in step S101 exceeds the given high pressure value P1 or not.

When the determination is affirmative (PR>P1) in step S104, the processing advances to step S109 and the permission flag of forced driving of the fuel injection valves 51 is set to F=1. Then, the processing advances to step S108 where the fuel pressure PR which is read this time is stored in a memory PROLD of the control device and the processing is finished. On the other hand, when the determination is negative (PR≦P1) in step S104, the processing advances to step S105.

In step S105, the forced fuel injection control means 102 determines whether the deviation (PR−PO) between the fuel pressure PR read in the step S101 and the target fuel pressure PO read in step S103 exceeds the given deviation P2 or not.

When the determination is affirmative (PR−PO>P2) in step S105, the processing advances to step S109 and the permission flag of forced driving of the fuel injection valves 51 is set to F=1. Then, the processing advances to step S108 where the fuel pressure PR which is read this time is stored in a memory PROLD of the control device and the processing is finished.

On the other hand, when the determination is negative (PR−PO≦P2) in step S105, the processing advances to step S106.

In step S106, the forced fuel injection control means 102 determines whether the fuel pressure PR read in step S101 exhibits the given elevation behavior against the target fuel pressure PO read in step S103 or not.

To be more specific, when the fuel pressure PR read this time is higher than the target fuel pressure PO and the fuel pressure PR read this time is higher than the fuel pressure PROLD read previous time by the given deviation P3 or more or not.

When the determination is affirmative (PR>PO and PR>PROLD+P3) in step S106, the processing advances to step S109 and the permission flag of forced driving of the fuel injection valves 51 is set to F=1. Then, the processing advances to step S108 where the fuel pressure PR which is read this time is stored in a memory PROLD of the control device and the processing is finished.

On the other hand, when the determination is negative in step S106, the processing advances to step S107 and the permission flag of forced driving of the fuel injection valves 51 is reset to F=0. Then, the processing advances to step S108 where the fuel pressure PR which is read this time is stored in a memory PROLD of the control device and the processing is finished.

As has been explained above, among conditions for determining any one of the fuel pressure states in step S104, step S105 and step S106 during the fuel cut control, when the determination is affirmative (determined that the given fuel pressure state is present), the processing advances to step S109 and the permission flag of the forced driving of the fuel injection valves 51 is set to F1=1.

Figure 3:
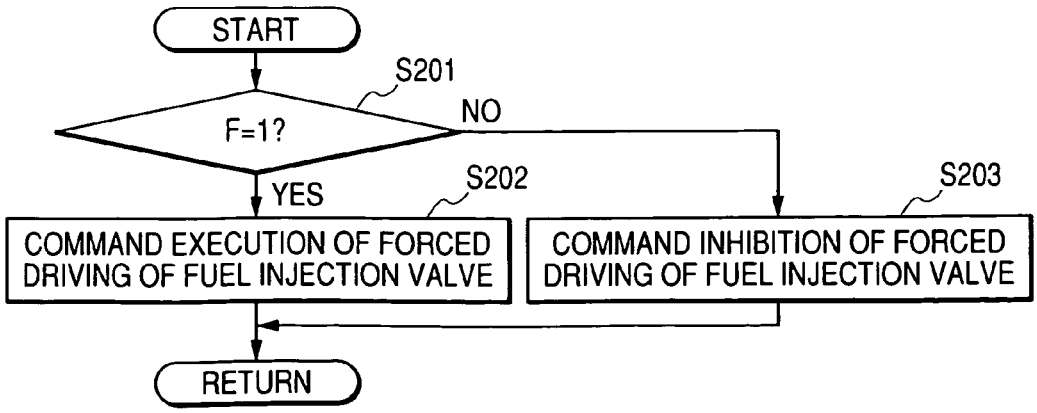
FIG. 3 is a flow chart showing control operations of the fuel injection control device of an internal combustion engine according to the embodiment 1 of the present invention.

Next, based on the state of the forced driving permission flag F of the fuel injection valves 51 set by the above-mentioned flow chart shown in FIG. 2, the control operation shown in FIG. 3 is executed.

In FIG. 3, first of all, the forced fuel injection control means 102 determines whether the forced driving permission flag is set to F=1 or not in step S201. When the determination is affirmative (F=1) in step 201, the processing advances to step S202 and the forced fuel injection control means 102 instructs the execution of the forced driving of the fuel injection valves 51 and the processing in this step S202 is finished.

On the other hand, when the determination is negative (F=0) in step 201, the processing advances to step S203 and the forced fuel injection control means 102 instructs the inhibition of the forced driving of the fuel injection valves 51 and the processing in this step S203 is finished.

The fuel injection valve control means 101 controls the driving or stop of the driving of the fuel injection valves 51 based on the execution instruction or the inhibition instruction of the fuel injection valves 51.

As described heretofore, according to the fuel injection valve control device of the embodiment 1 of the present invention, even in case the fuel cut control performed by the fuel injection valve control means is under way, when the fuel pressure in the inside of the pressure storage chamber 50 assumes the given pressure state, that is, when the fuel pressure in the pressure storage chamber 50 exceeds the preset given high pressure value, when the fuel pressure deviation between the fuel pressure in the inside of the pressure storage chamber and the target fuel pressure exceeds the preset given deviation, or when the fuel pressure in the inside of the pressure storage chamber exhibits a given elevation behavior against the target fuel pressure, the forced driving of the fuel injection valves of given cylinders is performed by interrupting the fuel cut control. Accordingly, it is possible to prevent the restarting of the injection of the fuel in a state that the fuel pressure in the inside of the pressure storage chamber is held excessively high during the fuel cut control whereby the deterioration of the exhaust gas and the occurrence of the engine stop can be prevented.

Further, when at least either one of a condition that the fuel pressure no more assumes the given pressure state after the forced driving of the fuel injection valves is started, and a condition that the fuel cut control is finished after the forced driving of the fuel injection valve is started is established, the forced driving of the fuel injection valves is released and hence, there is no possibility that the forced driving of the fuel injection valves is continued unnecessarily long whereby the fuel consumption loss can be minimized.

Embodiment 2

Figure 4:
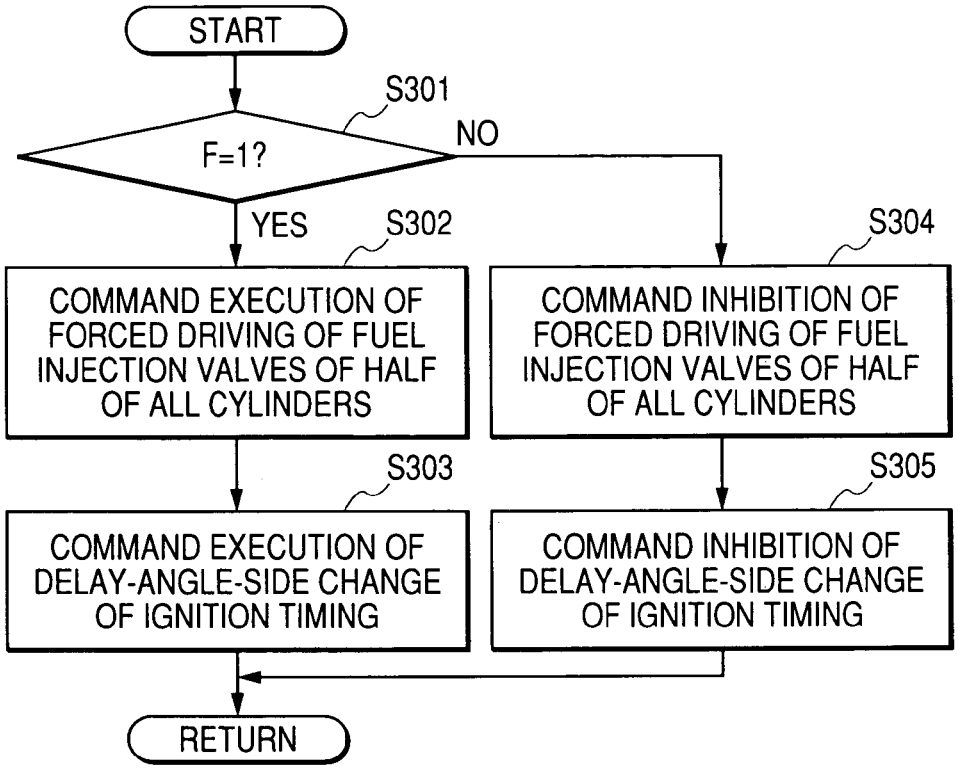
FIG. 4 is a flow chart showing control operations of a fuel injection control device of an internal combustion engine according to an embodiment 2 of the present invention.

FIG. 4 is a flow chart showing the control operation of the forced fuel injection control means 102 according to the embodiment 2 of the present invention.

The control operation shown in FIG. 4 is executed in place of the control operation shown in FIG. 3 based on the state of the forced driving permission flag F of the fuel injection valves 51 set in the above-mentioned flow chart shown in FIG. 2.

In FIG. 4, first of all, the forced fuel injection control means 102 determines whether the forced driving permission flag F is F=1 or not in step S301.

When the determination is affirmative (F=1) in step S301, the processing advances to step S302 and instructs the execution of the forced driving of the fuel injection valves 51 of half of all cylinders (for example, only given two cylinders in four-cylinder internal combustion engine). Then, the processing advances to next step S303 where the forced fuel injection control means 102 instructs the execution of the delay angle side change of the ignition timing to the ignition control means 103 and the processing in step S303 is finished. As the result, the forced driving is performed on only the fuel injection valves 51 of half of all cylinders (given two cylinders) and the ignition timing is controlled by changing the timing to the delay angle side.

On the other hand, when the determination is negative (F=0) in step S301, the processing advances to step S304 and instructs the inhibition of the forced driving of the fuel injection valves 51. Then, the processing advances to next step S305 where the forced fuel injection control means 102 instructs the inhibition of the delay angle side change of the ignition timing to the ignition control means 103 and the processing in step S305 is finished. As the result, the forced driving of the fuel injection valves 51 is inhibited and the change of the ignition timing to the delay angle side is also inhibited.

As mentioned above, according to the fuel injection control device of the embodiment 2 of the present invention, in performing the forced driving of the fuel injection valves by interrupting the fuel cut control, out of all cylinders of the engine, the forced driving is performed only with respect to the fuel injection valves which are arranged in half of these cylinders and/or the ignition timing when the forced driving is performed with respect to the fuel injection valves is set to the delay angle side than the normal ignition timing such that the generated torque of the engine can be suppressed. Accordingly, at the time of performing the forced driving of the fuel injection valves by interrupting the fuel cut control, it is possible to suppress the generated torque of the engine to the minimum value whereby the desired deceleration performance can be ensured even when the forced driving of the fuel injection valves is performed.

Embodiment 3

Figure 5:
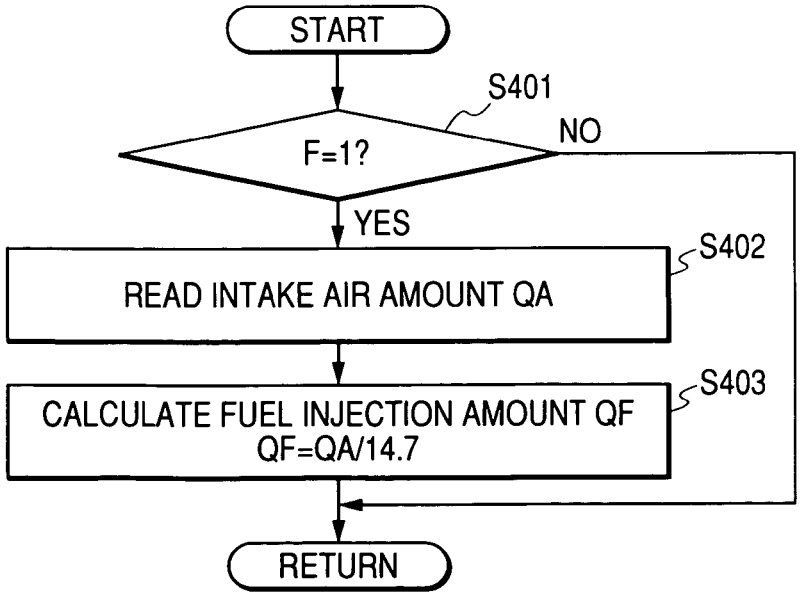
FIG. 5 is a flow chart showing control operations of a fuel injection control device of an internal combustion engine according to an embodiment 3 of the present invention.

FIG. 5 is a flow chart showing the control operation of the forced fuel injection control means 102 according to the embodiment 3 of the present invention.

The control operation shown in FIG. 5 is executed based on the state of the forced driving permission flag F of the fuel injection valves 51 set in the above-mentioned flow chart shown in FIG. 2.

In FIG. 5, first of all, the forced fuel injection control means 102 determines whether the forced driving permission flag F is F=1 or not in step S401. When the determination is affirmative (F=1) in step S401, the processing advances to step S402 and the forced fuel injection control means 102 reads the intake air amount QA detected by the air flow sensor 65 and the processing advances to step S403. In step S403, the fuel injection amount QF which brings the theoretical air-fuel ratio with respect to the intake air amount QA read in step S402 is calculated and the processing in this step S403 is finished.

The fuel injection valve control means 101 performs the driving control of the fuel injection valves 51 such that the fuel injection amount QF calculated in step S403 is supplied to the combustion chamber of the engine 40.

On the other hand, when the determination is negative (F=0) in step S401, no particular processing is made and the processing advances to the next step.

As has been described heretofore, according to the fuel injection control device of the embodiment 3 of the present invention, when the forced driving of the fuel injection valves is performed, the fuel injection amount is set such that the air-fuel ratio of the cylinders on which the forced driving is performed assumes a value close to the theoretical air-fuel ratio. Accordingly, even in a spark ignition gasoline engine which performs the uniform combustion operation by premixing a fuel of an amount in the vicinity of the theoretical air-fuel ratio to the intake air flow rate in the combustion chamber, it is possible to perform the forced driving of the fuel injection valves in a stable combustion state whereby the deterioration of an exhaust gas and the occurrence of the engine stop can be obviated.

Figure 6:
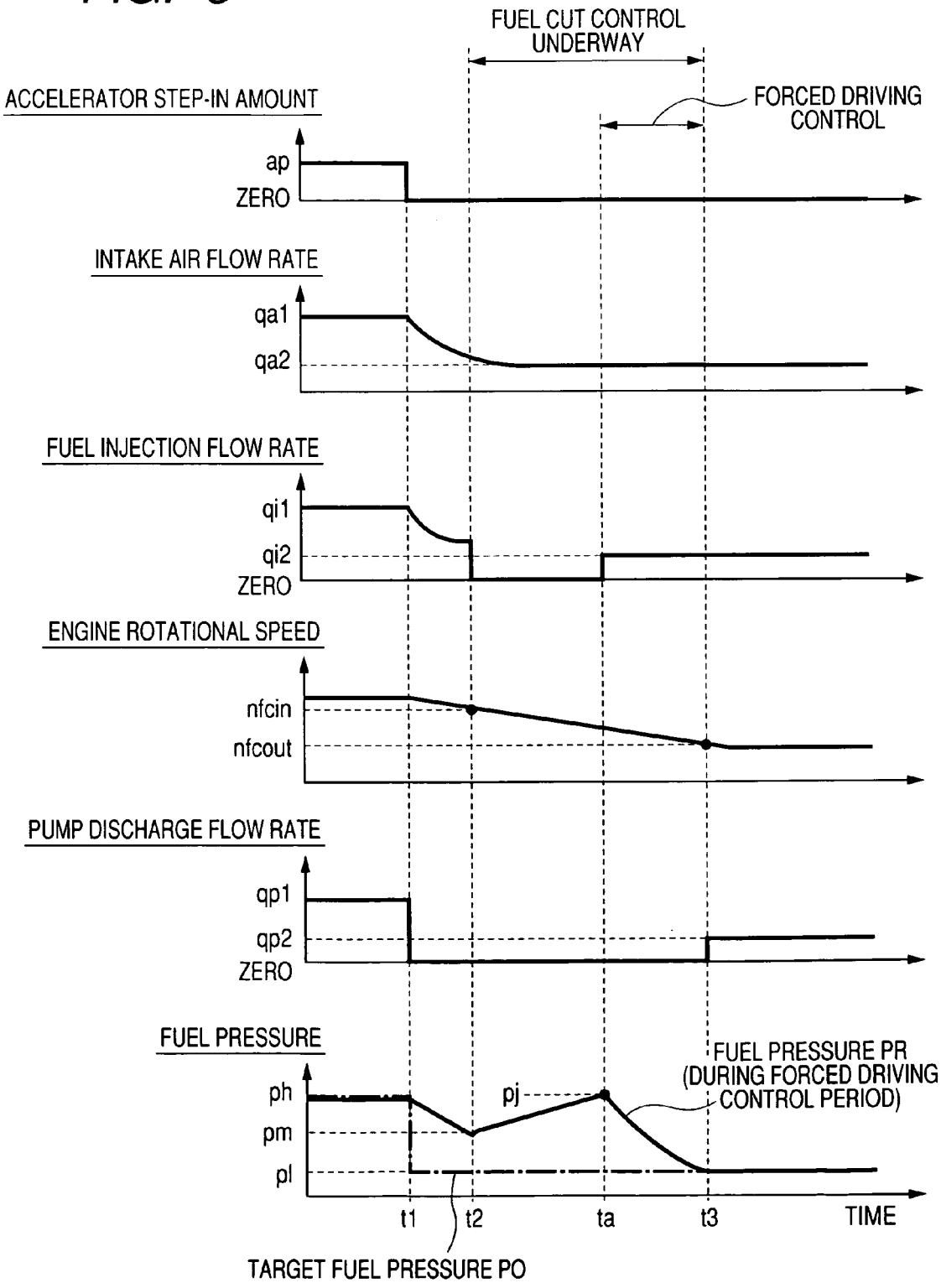
FIG. 6 is a timing chart which shows one example of changes of various state variables when an engine is shifted from a steady state operation to a deceleration operation when the fuel injection control device of the present invention is used.
Figure 7:
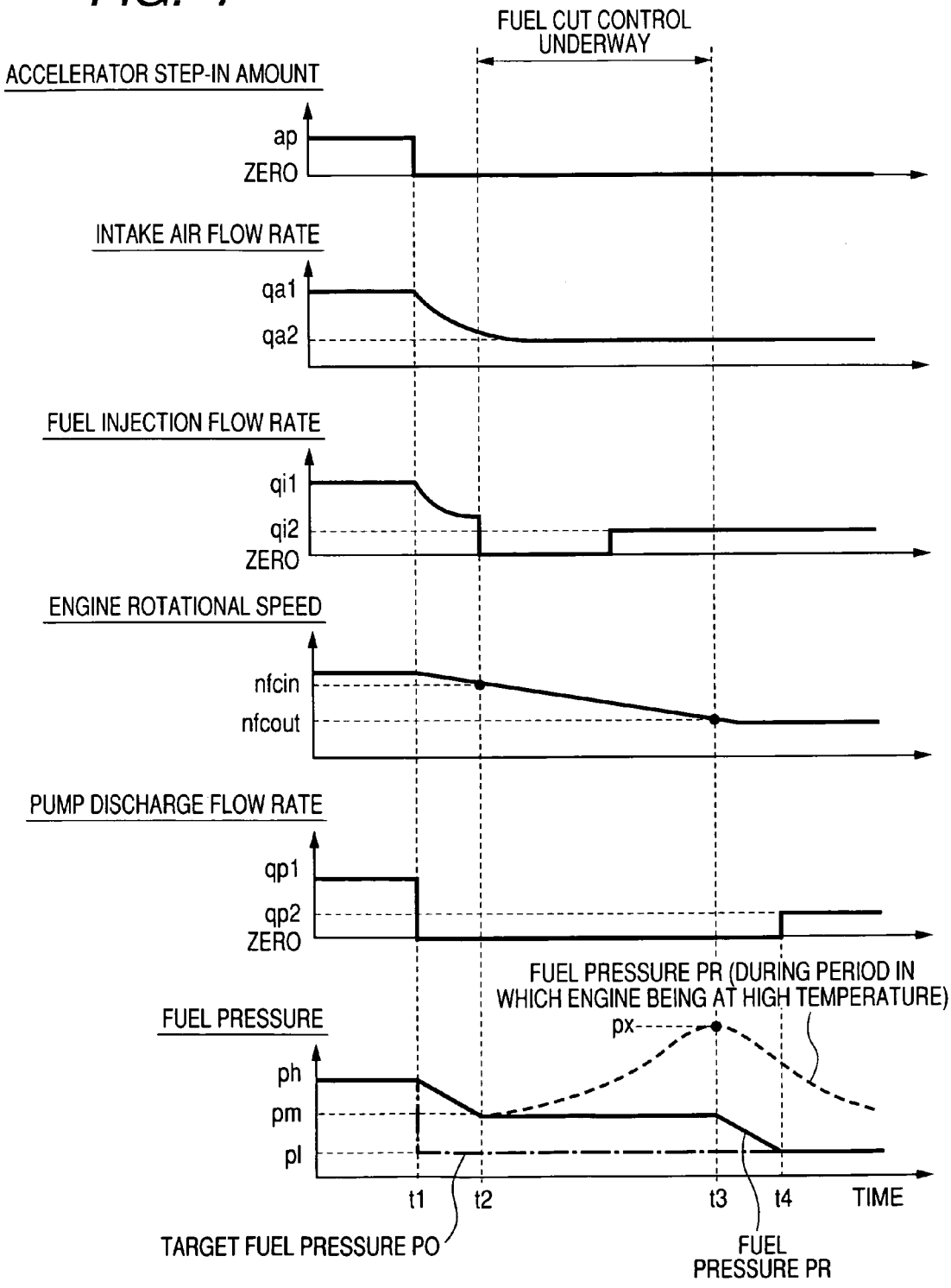
FIG. 7 is a timing chart which shows one example of changes of various state variables when an engine is shifted from a steady state operation to a deceleration operation in a conventional fuel injection control device.

FIG. 6 is a timing chart which shows one example of changes of various state variables when the engine in a high-temperature state is shifted from a steady state operation to a deceleration operation when the fuel injection control device for an internal combustion engine of the present invention is used. Here, since the behavior up to the point of time t2 in FIG. 6 is equal to the behavior up to the point of time t2 in FIG. 7, only the behavior after the point of time t2 which differs from the corresponding behavior in FIG. 7 is explained hereinafter.

In FIG. 6, when the engine rotational speed is lowered to the fuel cut start rotational speed nfcin at the point of time t2, the fuel cut control is started and the fuel injection flow rate is controlled to zero.

When the fuel injection flow rate becomes zero, although the consumption of the fuel in the inside of the pressure storage chamber 50 is stopped, since the engine is at the high temperature, the fuel pressure PR (pm at the point of time t2) in the inside of the pressure storage chamber 50 indicated by a solid line starts the rapid elevation in the same manner as the conventional fuel injection control device.

Thereafter, for example, when the elevated fuel pressure PR at the point of time ta exceeds a given high pressure value pj, it is determined that the fuel pressure reaches a given fuel pressure state. Then, based on the intake air flow rate qa2 at this point of time and the target air-fuel ratio which is preliminarily set in response to the engine operation state, the fuel injection flow rate qi2 which makes the air-fuel ratio approach the target air-fuel ratio is forcibly injected from the fuel injection valves 51.

As a result, the fuel in the pressure storage chamber 50 is consumed in response to the injected fuel injection flow rate qi2 and hence, the fuel pressure PR after the point of time ta is gradually lowered from pj.

Then, when the engine rotational speed is lowered to the fuel cut finish rotational speed nfcout at the point of time t3, the fuel cut control is stopped or the fuel pressure-PR indicated by a solid line no more assumes the state in which the fuel pressure PR indicated by a solid line exhibits the given elevation behavior against the target fuel pressure PO (for example, the fuel pressure PR indicated by the solid line and the target fuel pressure PO indicated by the chain line agree with each other) and hence, the forced driving of the fuel injection valves 51 is finished. Then, after the point of time t3, the usual fuel injection is restarted in the state in which the fuel pressure PR (=p1) indicated by the solid line substantially agrees with the target fuel pressure PO (p1) indicated by the chain line and hence, it is possible to obviate the conventionally-held fear on the occurrence of the deterioration of the exhaust gas attributed to the restarting of the injection of fuel at the high fuel pressure value and the occurrence of engine stop attributed to the lowering of the response property of the fuel injection valves 51.

What is claimed is:

1. A fuel injection control device of an internal combustion engine comprising:

fuel injection valves which directly inject fuel in the inside of combustion chambers of an engine;

fuel injection valve control means which performs a driving control of the fuel injection valves by calculating a fuel injection amount which brings a target air fuel ratio which is preliminarily set in response to an engine operation state;

a pressure storage chamber which is connected with the fuel injection valves and stores high-pressure fuel;

a fuel pressure sensor which detects a fuel pressure in the inside of the pressure storage chamber;

a high-pressure pump which pressurizes fuel transported from a fuel tank in the inside of a pressurizing chamber and supplies the high-pressure fuel to the pressure storage chamber;

a discharge amount control valve which controls a fuel amount supplied from the high-pressure pump to the pressure storage chamber; and fuel pressure control means which performs a feedback control of a discharge amount control valve such that the fuel pressure in the inside of the pressure storage chamber detected by the fuel pressure sensor agrees with a target fuel pressure which is set in response to the engine operation state, wherein the fuel injection control device includes forced fuel injection control means which, when the fuel pressure in the inside of the pressure storage chamber assumes a given pressure state during a fuel cut control using the fuel injection valve control means, gives a driving instruction to the fuel injection valve control means to interrupt the fuel cut control and enables forced driving of the fuel injection valves of given cylinders with a fuel injection amount corresponding to the engine operation state.

2. A fuel injection control device of an internal combustion engine according to claim 1, wherein the given pressure state is a state in which the fuel pressure in the inside of the pressure storage chamber exceeds a given high pressure value.

3. A fuel injection control device of an internal combustion engine according to claim 1, wherein the given pressure state is a state in which a fuel pressure deviation between the fuel pressure in the inside of the pressure storage chamber and the target fuel pressure exceeds a preliminarily set given deviation.

4. A fuel injection control device of an internal combustion engine according to claim 1, wherein the given pressure state is a state in which the fuel pressure in the inside of the pressure storage chamber exhibits a given elevation behavior against the target fuel pressure.

5. A fuel injection control device of an internal combustion engine according to claim 1, wherein the fuel injection valve on which the forced driving is performed is constituted of fuel injection valves which are arranged on half of all cylinders of the engine.

6. A fuel injection control device of an internal combustion engine according to claim 1, wherein the ignition timing when the forced driving is performed on the fuel injection valve is set to the delay angle side than the usual ignition timing so as to suppress a generated torque of the engine.

7. A fuel injection control device of an internal combustion engine according to claim 5, wherein the ignition timing when the forced driving is performed on the fuel injection valve is set to the delay angle side than the usual ignition timing so as to suppress a generated torque of the engine.

8. A fuel injection control device of an internal combustion engine according to claim 1, wherein when at least either one of a condition that the fuel pressure in the inside of the pressure storage chamber no more assumes the given pressure state after the forced driving of the fuel injection valves is started, and a condition that the fuel cut control by the fuel injection valve control means is finished after the forced driving of the fuel injection valve is started is established, the forced driving of the fuel injection valves is released.

* * * * *